United States Patent [19]

Zelenko

[11] 4,083,136

[45] Apr. 11, 1978

[54] COMPACT NOTE SCROLL

[76] Inventor: Harry Zelenko, 240 E. 61st St., New York, N.Y. 10021

[21] Appl. No.: 741,671

[22] Filed: Nov. 15, 1976

[51] Int. Cl.[2] ..... G09F 11/24

[52] U.S. Cl. ..... 40/518; 40/21 C; 281/8; 40/385

[58] Field of Search ..... 40/86, 86 R, 21 C; 281/6, 7, 8, 9

[56] References Cited

U.S. PATENT DOCUMENTS

| | | | |
|---|---|---|---|
| 1,731,192 | 10/1929 | Doboi | 281/7 |
| 2,546,483 | 3/1951 | Venters | 281/7 |
| 3,698,113 | 10/1972 | Spicer | 40/21 C X |

FOREIGN PATENT DOCUMENTS

| | | | |
|---|---|---|---|
| 76,105 | 11/1977 | Switzerland | 281/8 |

*Primary Examiner*—Louis G. Mancene
*Assistant Examiner*—Wenceslao J. Contreras
*Attorney, Agent, or Firm*—Edward F. Levy

[57] ABSTRACT

A compact note scroll includes a base on which a pair of rotatably mounted shafts carry an elongated strip of paper, an intermediate portion of which is accessible for writing thereon through a window aperture in a case which covers the base. The case has a wrist strap and the device may be worn on the wrist in the manner of a wrist watch. The shafts may be manually rotated to advance fresh portions of the strip of paper successively into registry with the window aperture.

7 Claims, 4 Drawing Figures

FIG. 1
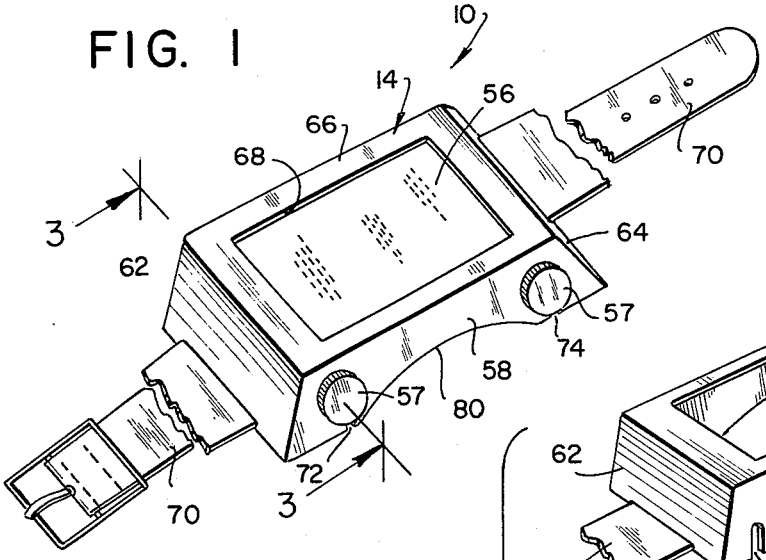
FIG. 2
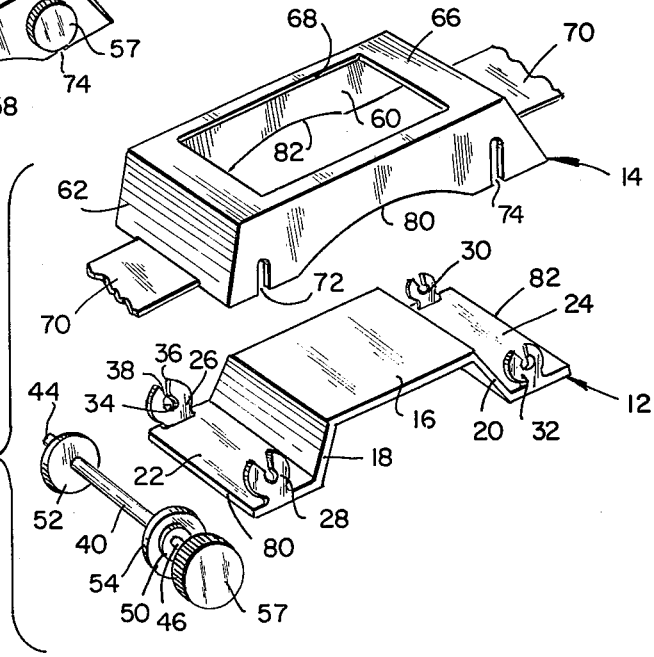
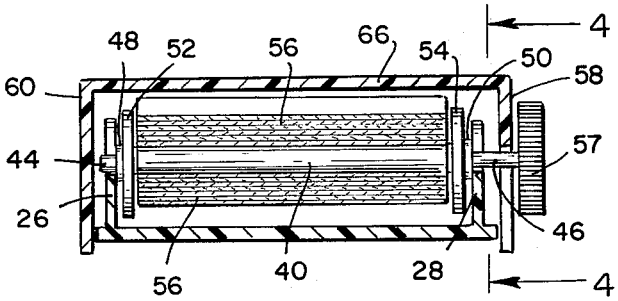
FIG. 3
FIG. 4
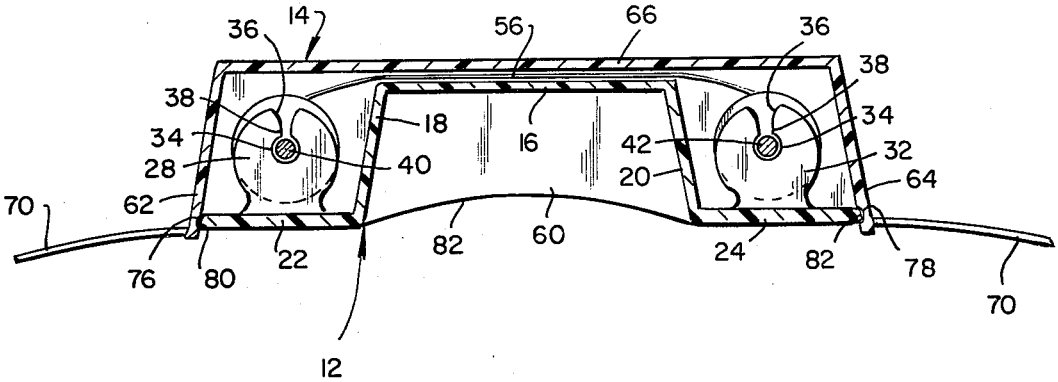

COMPACT NOTE SCROLL

The present invention relates generally to the field of writing materials and, more particularly, to a compact note scroll which may be worn on the wrist of a user is a manner similar to a wrist watch.

People engaged in creative work often find that they wish to make record of their thoughts or ideas at times when they are remote from their normal work locations. In order to make such notes, people often resort to various expedients such as carrying a supply of paper or a writing tablet in the pockets of their clothing. Such expedients are usually unsatisfactory to various degrees due to the inconvenience of carrying such a supply of paper or a writing tablet, which are generally bulky items, and the frequent damage and loss of notes carried about in the pockets of clothing. At best the loss of such notes is an inconvenience, and at worst valuable material can be lost irrevocably.

The present invention overcomes the limitations of the prior art by providing a compact note scroll which has a wrist band and is worn on the wrist of a user in a manner similar to a wrist watch. The compact note scroll includes a base on which a pair of rotatably mounted shafts are disposed. The shafts are generally parallel to each other and an elongated strip of paper has a first end removeably connected to the first of the rotatably mounted shafts and a second end removeably connected to the second of the rotatably mounted shafts. A longer end portion of the paper strip is wound on the first shaft, an intermediate portion of the paper strip passes over a support surface formed on the base and a shorter end portion of the paper strip is wound on the second shaft. The base of the compact note scroll fits within a case which includes an aperture which is centered over a table surface formed on the base. The intermediate portion of the paper strip is accessible through the aperture and the table surface supports the paper for writing. After a section of the paper strip has been written upon, fresh sections of the paper strip may be brought into alignment with the aperture, and may be written upon, in turn, by unwinding a portion of the paper strip from the first shaft and winding the already written upon portion of the paper strip onto the second shaft, thus advancing the paper strip.

The case includes a wrist strap and the compact note scroll may be conveniently worn on the wrist in the manner of a wrist watch.

It is an object of the present invention to provide a compact writing scroll which may be worn on the wrist of a user and is constantly available for inscribing notes, memos and other written matter thereon.

Another object of the present invention is to provide a compact writing scroll which contains an extensive supply of writing paper in a compact manner.

Another object of the present invention is to provide a writing scroll in which a strip of paper can be advanced to present fresh sections in a convenient manner.

Still another object of the present invention is to provide a compact writing scroll which is light in weight, having relatively few simple parts and which is economical of manufacture.

Additional objects and advantages of the invention will become apparent during the course of the following specification, when taken in connection with the accompanying drawings in which:

FIG. 1 is an overall perspective view of a compact note scroll made in accordance with the present invention;

FIG. 2 is an exploded perspective view of the compact note scroll of FIG. 1;

FIG. 3 is a transverse cross-sectional view taken along the line 3—3 of FIG. 1; and FIG. 4 is a longitudinal cross-sectional view taken along the line 4—4 of FIG. 3.

Referring in detail to the drawings, there is shown in FIG. 1 a compact note scroll 12 made in accordance with the present invention and generally comprising a base member 12 upon which a case member 14 is releasably mounted. The base 12 and case 14 are preferably molded of a rigid plastic material.

As shown in FIG. 2, the base 12 is made of a rectangular plate formed with a raised central table portion 16 joined by a pair of inclined walls 18 and 20 to respective flat end portions 22 and 24. As shown in FIG. 3, the end portions 22 and 24 are coplanar, and the table portion 16 is upwardly stepped relative thereto. Four shaft support brackets 26, 28, 30 and 32 are formed integrally with the side edges of the respective end portions 22 and 24. Each shaft support bracket is in the form of an upstanding lug having a central circular aperture 34 and a converging slot 36 opening through the top edge of the bracket and communicating with the circular aperture 34. The diameter of the circular aperture 34 is somewhat greater than the width of the lower end portion 38 of the converging slot 36.

A pair of cylindrical shafts 40 and 42 are rotatably mounted in the transversely-aligned pairs of shaft support brackets 26, 28 and 30, 32. Each shaft 40 and 42 has a pair of end bearing portions 44 and 46 of reduced diameter which rotate within the circular aperture 34 and a pair of intermediate cylindrical portions 48 and 50 of larger diameter (FIG. 3) which are disposed inwardly of the bearing portions 44, 46 and which fit between the shaft support brackets 26, 38 and 30, 32, serving to center the shafts 40 and 42 on said brackets. Each of the shafts 40 and 42 is also formed with a pair of relatively large circular flanges 52 and 54 which are disposed inwardly of the intermediate portions 48 and 50 and which serve to guide the edges of a strip of paper 56, the end portions of which are wound on the shafts 40 and 42. Each of the shafts 40 and 42 terminates at one end in a winding knob 57 mounted upon the bearing portion 46 for the purpose of rotating the shafts 40 and 42 during operation of the compact note scroll 10 in a manner to be described hereinafter.

The paper strip 56 is provided in as long a length as is practical, for example, it may be several feet long. One end of the paper strip 56 is initially attached to one of the shafts, for example, the shaft 40, and wound thereon in a roll as shown in FIG. 3. The other end of the paper strip 56 is attached to the opposite shaft 42.

The upper surface of the table portion 16 is flat and smooth, providing a writing support for an intermediate portion of the elongated strip of paper 56 which is wound on the shafts 40 and 42. The pairs of shaft support brackets 26, 28 and 30, 32, and the shafts 40 and 42 rotatably mounted therein, are located well below the level of the table portion 16 so that the paper strip 56 extends upwardly from each of shafts 40 and 42 to the table portion 16, with the intermediate portion of the strip resting flush upon the flat outer surface of the table portion and being supported thereby.

The case member 14 is in the form of an inverted rectangular box having parallel side walls 58 and 60, outwardly-inclined end walls 62 and 64, and a flat top wall 66. A rectangular window aperture 68 is formed in the top wall 66, this aperture 68 being slightly smaller than the table portion 16 and overlying the latter in the mounted position of the case 14. A wrist strap 70, which may be in the form of any conventional wrist strap normally worn on wrist watches, is attached to the lower edge portions of end walls 62 and 64.

The case 14 is sized to be mounted on the base 12 in a position in which it covers over the upper surfaces of the base, the shafts 40, 42 and the paper strip 56 wound on the shafts. The case side wall 58 has a pair of slots 72 and 74 at each end thereof extending upwardly from lower edge of said side wall. When the case 14 is mounted on the base 12, the elongated bearing portions 46 of the shafts 40, 42 extend through the respective slots 72 and 74 so that the terminal winding knobs 57 are located outside the case 14, as shown in FIGS. 1 and 3, and are thus accessible for manual rotation to advance the paper strip across the top of the base table portion 16. The slots 72 and 74 also permit the case 14 to be removed from the base 12 leaving the shafts 40 and 42 in place within the brackets 26, 28 and 30, 32.

In order to releasably secure the case 14 to the base 12 in mounted position thereon, the case 14 is provided with detent means in the nature of recessed grooves 76 and 78 on the inner surfaces of the respective end walls 62 and 64, proximate to the lower edges thereof. These grooves 76 and 78 are sized and positioned to receive and retain therein the end edges 80 and 82 of the base and portion 22 and 24 when the case 14 is mounted of base 12. The distance between these grooves 76 and 78 is slightly less than the distance between the end edges 80 and 82 of the base end portions 22 and 24, so that when the case 14 is pressed down upon the base 12, the edges 80 and 82 snap within the grooves 76 and 78 and are releasably retained therein, as shown in FIG. 4.

The lower edges of the case side walls 58 and 60 are formed with arcuate recessed portions 84 and 86 centered in said lower edges and sized and positioned to extend between the base inclined walls 18 and 20 when the case 14 is mounted on base 12, as shown in FIG. 4. The arcuate recessed portions 84 and 86 conform generally to the curvature of the wrist of the user, thus permitting the compact note scroll 10 to be worn comfortably on the wrist and also locating the case top wall relatively close to the user's wrist, thereby reducing the overall bulkiness of the note scroll 10. By means of the wrist strap 70, the compact note scroll 10 is strapped to the wrist in the manner of a conventional wrist watch, in which position it is constanly available for the writing of notes upon the portion of the paper strip 56 which registers with the window aperture 68.

In use, one end of the strip 56 of paper, or other suitable writing material, is attached to the shaft 42 and the other end portion of the strip is attached to and wound in a roll about the opposite shaft 40. The shafts 40 and 42 are then mounted in the aligned pairs of brackets 26, 28 and 30, 32 by being pressed through the converging slots 36 into the circular apertures 34 of the respective brackets. The shafts 40 and 42 snap past the slot lower end portions 38 of reduced width, and are securely retained within the circular apertures 34, although they may be later removed therefrom, by upward manual pressure, for replacement by shafts carrying a fresh strip of paper. The case 14 is then snapped to its mounted position upon base 12.

At selected intervals, notes are made on the intermediate portion of the paper strip 56 which is visible and accessible through the rectangular window aperture 68. When required, a fresh section of paper is brought into registry with the window aperture 14 by turning one of the knobs 57 in a direction to unroll a portion of the paper strip 56 from the shaft 40 and rolling the written-upon portion onto the shaft 42. During this movement, the paper strip is guided between the top wall 66 of case 14 and the underlying base table portion 16.

When the entire paper strip 56 is covered with writing, the case 14 may be removed from the base 12 for removal of the used paper strip and replacement by a fresh paper strip. For this purpose, the shafts 40 and 42 may be easily unsnapped from mounted position within the shaft supporting brackets and removed for attachment of a new strip of paper thereon or for replacement by a new set of shafts carrying a fresh paper strip.

When the strip 56 is made of paper, it is necessary to replace the paper strip after it has become completely covered with writing. However, the strip 56 may be provided in substantially permanent form by forming it of coated flexible plastic or thin sheet metal, so that the written material thereon may be easily erased by rubbing with a cloth or the like. In this instance, when the surface of the strip is covered with writing, it is only necessary to erase the same through the window aperture 68, and the strip need only be replaced in case of damage thereto.

At least a portion of the strip 56 may also be printed with permanent data or information such as metric conversion tables, calendars, or the like. Because of the small size of the window aperture 68, in many instances such printing must be necessarily small and difficult to read. To permit such small print to be read more easily, a snap-in magnifying lens may be provided to cover the window aperture 68 and magnify the surface of the strip 56 therebeneath.

While a preferred embodiment of the invention has been shown and described herein, it is obvious that numerous additions, changes and omissions may be made in such embodiment without departing from the spirit and scope of the invention.

What is claimed is:

1. A note scroll adapted to be worn on the wrist of a person, comprising a base, a hollow case having an open bottom end sized to receive said base therein to provide a closed housing with said base serving as the bottom wall thereof, means for releasably mounting said hollow case on said base, said base comprising a pair of flat end sections, a pair of inclined walls upstanding from said end sections, a flat table portion extending between said inclined walls, and a pair of spaced lugs upstanding from the side edges of each of said flat end sections, a pair of spaced apart shafts rotatably mounted in the upstanding lugs of the base end sections, an elongated flexible writing strip having a first end attached to one of said shafts and a second end attached to the other of said shafts, with a portion of said strip wound in a roll around at least one of said shafts, the flat table portion of said base underlying an intermediate portion of said flexible writing strip between said shafts, said case having a top wall formed with a window aperture extending over substantially the entire extent of said top wall and positioned to register with said base table portion and the intermediate portion of said flexible strip thereon, and means for rotating said shafts in a direction to advance said flexible strip across the surface of said table portion, said case having a pair of side walls and a pair of end walls, each of said side walls having an arcuate recessed portion on the lower edge thereof, sized to conform to the wrist of the wearer, said note scroll also including a wrist strap connected to the end walls of said case.

2. A note scroll according to claim 1 in which said table portion is positioned on a level above the level of said shafts.

3. A note scroll according to claim 2 in which the end walls of said case engage the end edges of said base end sections, each case end wall having a groove therein positioned to receive said base end edges for releasably attaching said case in mounted position on said base.

4. A note scroll according to claim 2 in which said base table portion is disposed proximate to the upper wall of said case in the mounted position of said case, said table portion and said case upper walls providing guide surfaces to guide said flexible writing strip along the surface of said table portion.

5. A note scroll according to claim 1 in which each of said lugs is integrally formed at each side edge of each of said base end sections, each of said lugs having a circular aperture sized to receive the end portion of a shaft rotatably therein, and a converging slot communicating with said circular aperture for removably mounting said shaft in said circular aperture.

6. A note scroll according to claim 5 in which one of said case side walls has a pair of spaced slots extending inwardly from the free lower edge thereof, each of said shafts having an end portion extending beyond the adjacent lug and projecting through one of said slots.

7. A note scroll according to claim 6 in which each of said shaft end portions terminates in a winding knob located exteriorly of said case.

* * * * *